US007841040B2

(12) United States Patent
Strunk et al.

(10) Patent No.: US 7,841,040 B2
(45) Date of Patent: Nov. 30, 2010

(54) ABSORBENT CLEANING PAD WITH EXTENDED PORTION FOR USE WITH A CLEANING IMPLEMENT

(75) Inventors: Kevin Brian Strunk, Boyertown, PA (US); Suzann E. Shreck, Phoenixville, PA (US)

(73) Assignee: First Quality Retail Services, LLC, Great Neck, NY (US)

( * ) Notice: Subject to any disclaimer, the term of this patent is extended or adjusted under 35 U.S.C. 154(b) by 161 days.

(21) Appl. No.: 11/526,982

(22) Filed: Sep. 26, 2006

(65) Prior Publication Data

US 2008/0072390 A1 Mar. 27, 2008

(51) Int. Cl.
*A47L 13/12* (2006.01)

(52) U.S. Cl. ..... 15/118; 15/105; 15/228

(58) Field of Classification Search ..... 15/118, 15/105, 104.001, 228, 209.1, 210.1, 231, 15/244.1

See application file for complete search history.

(56) References Cited

U.S. PATENT DOCUMENTS 3,321,796 A * 5/1967 Lelifcoff ..... 15/104.94
6,172,276 B1 1/2001 Hetzler et al.
7,047,586 B2 * 5/2006 Shimada et al. ..... 15/104.002
2003/0229958 A1 * 12/2003 Thompson et al. ..... 15/104.002
2004/0019995 A1 * 2/2004 Kowalski et al. ..... 15/231
2007/0074364 A1 * 4/2007 Glaug ..... 15/228

FOREIGN PATENT DOCUMENTS

WO WO 2004/017883 3/2004

* cited by examiner

*Primary Examiner*—Dung Van Nguyen
(74) *Attorney, Agent, or Firm*—Amster, Rothstein & Ebenstein LLP

(57) ABSTRACT

A surface cleaning pad is provided comprising a pad body including a primary portion and a secondary portion contiguous with the primary portion. An attachment member is coupled to the primary portion of the pad body, whereby the attachment member is configured for releasable attachment to a primary surface of a cleaning implement. An attachment member is coupled to the secondary portion of the pad body, wherein the attachment member is configured for releasable attachment to a secondary surface of a cleaning implement. The primary portion and the secondary portion of the pad body are each configured to be independently positioned against a soiled surface.

23 Claims, 6 Drawing Sheets

ABSORBENT CLEANING PAD WITH EXTENDED PORTION FOR USE WITH A CLEANING IMPLEMENT

FIELD OF THE INVENTION

The present invention relates to an absorbent cleaning pad having an extended portion provided for scrubbing a soiled surface and/or collecting dirt particles.

BACKGROUND OF THE INVENTION

Commercially available floor mops typically comprise a handle rotatably connected to a mop head and a disposable absorbent cleaning pad coupled to the underside surface of the mop head. The absorbent cleaning pad is adapted for cleaning a soiled surface. In practice, an attachment surface of the cleaning pad is releasably coupled to the underside of the mop head, and a cleaning surface of the cleaning pad is positioned in cleansing contact with a surface to be cleaned. The absorbent pad absorbs and retains fluids and loosens and traps dirt particles on the cleaning surface.

Various commercially available floor mop heads include an abrasive component releasably attached to either the top surface or side surface of the pivotable mop head for dislodging stubborn dirt particles from a soiled surface. The top surface or side surface of the mop head is referred to herein as a secondary attachment surface. To utilize the abrasive component, the mop head is pivoted about its pivot axis such that the abrasive component is positioned to face the soiled surface. Thereafter, a user may cleanse the soiled surface using the abrasive component. In such floor mops, the abrasive component is wholly separate from the cleaning pad that is releasably coupled to the underside of the mop head. The abrasive component commonly includes a hook fastener or loop fastener for fastening to the secondary attachment surface of the mop head. It follows that the secondary attachment surface of the mop head, upon which the abrasive component is releasably attached, includes a mating loop fastener or hook fastener.

There is a need to further refine and improve absorbent cleaning implements in the interest of user convenience and functionality.

SUMMARY OF THE INVENTION

According to one aspect of the invention, a surface cleaning pad is provided comprising a pad body including a primary portion and a secondary portion contiguous with the primary portion. An attachment member is coupled to the primary portion of the pad body, whereby the attachment member is configured for releasable attachment to a primary surface of a cleaning implement. An attachment member is coupled to the secondary portion of the pad body, wherein the attachment member is configured for releasable attachment to a secondary surface of the cleaning implement. The primary portion and the secondary portion of the pad body are each configured to be independently positioned against a soiled surface.

According to another aspect of the invention, the secondary portion includes an adhesive component configured for removing dirt from a soiled surface.

According to still another aspect of this invention, a surface cleaning implement is provided. The surface cleaning implement comprises a head portion defining a primary surface and a secondary surface, wherein the primary surface and the secondary surface are non coplanar. The surface cleaning implement further comprises a pad body including a primary portion and a secondary portion contiguous with the primary portion, wherein the primary portion of the pad body is releasably coupled to the primary surface of the head portion by an attachment member, and the secondary portion of the pad body is releasably coupled to the secondary surface of the head portion by an attachment member.

BRIEF DESCRIPTION OF THE DRAWINGS

Exemplary embodiments of the invention will be described with reference to the drawings, of which.

DETAILED DESCRIPTION OF THE INVENTION

Figure 1A:
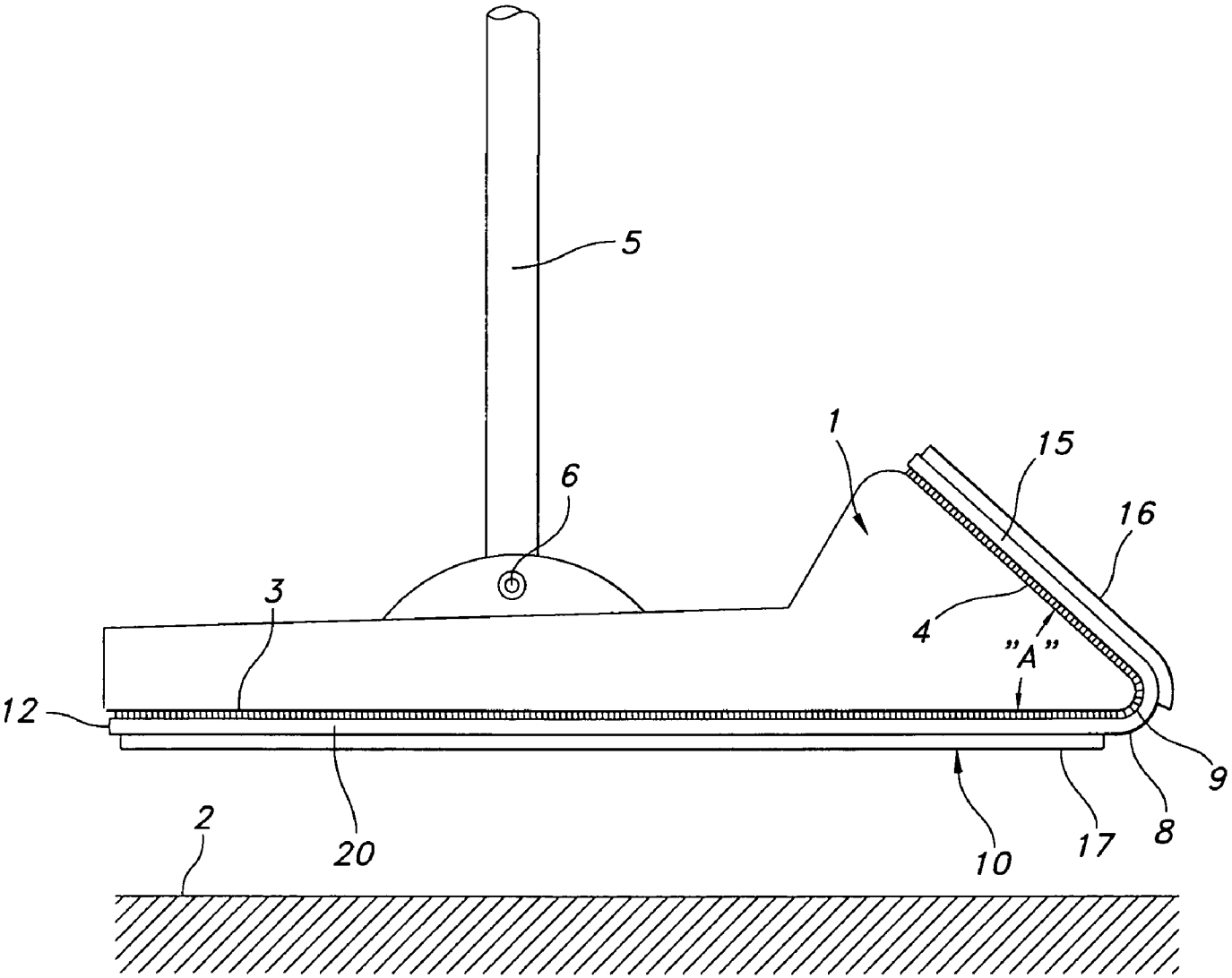
FIG. 1A is an end view of a cleaning implement comprising a head portion and an absorbent cleaning pad shown schematically, in accordance with an exemplary embodiment of the present invention, wherein the cleaning implement is illustrated in a sweeping configuration.

Although the invention is illustrated and described herein with reference to specific embodiments, the invention is not intended to be limited to the details shown. Rather, various modifications may be made in the details within the scope and range of equivalents of the claims and without departing from the invention. Also, the embodiments selected for illustration in the figures are not shown to scale and are not limited to the proportions shown. In the figures, like numerals represent like features of the various embodiments.

This invention relates to a disposable cleansing pad configured for releasable attachment to a commercially available floor mop. The cleansing pad is generally used for cleaning soiled surfaces. Multiple exemplary embodiments of the cleaning pad are described below.

Referring generally to the figures, according to one aspect of the invention, a surface cleaning pad 10, 110, 210 is provided comprising a pad body 12, 112, 212 including a primary portion 20, 120, 220 and a secondary portion 15, 115, 215 contiguous with the primary portion. An attachment member 18 is coupled to the primary portion 20, 120, 220 of the pad body, whereby the attachment member is configured for releasable attachment to a primary surface 3 of a cleaning implement 1. An attachment member 18, either the same or a separate attachment member, is coupled to the secondary portion 15, 115, 215 of the pad body, wherein the attachment member 18 is configured for releasable attachment to a secondary surface 4 of the cleaning implement. The primary portion 20, 120, 220 and the secondary portion 15, 115, 215 of the pad body are each configured to be independently positioned against a soiled surface 2.

Figure 1B:
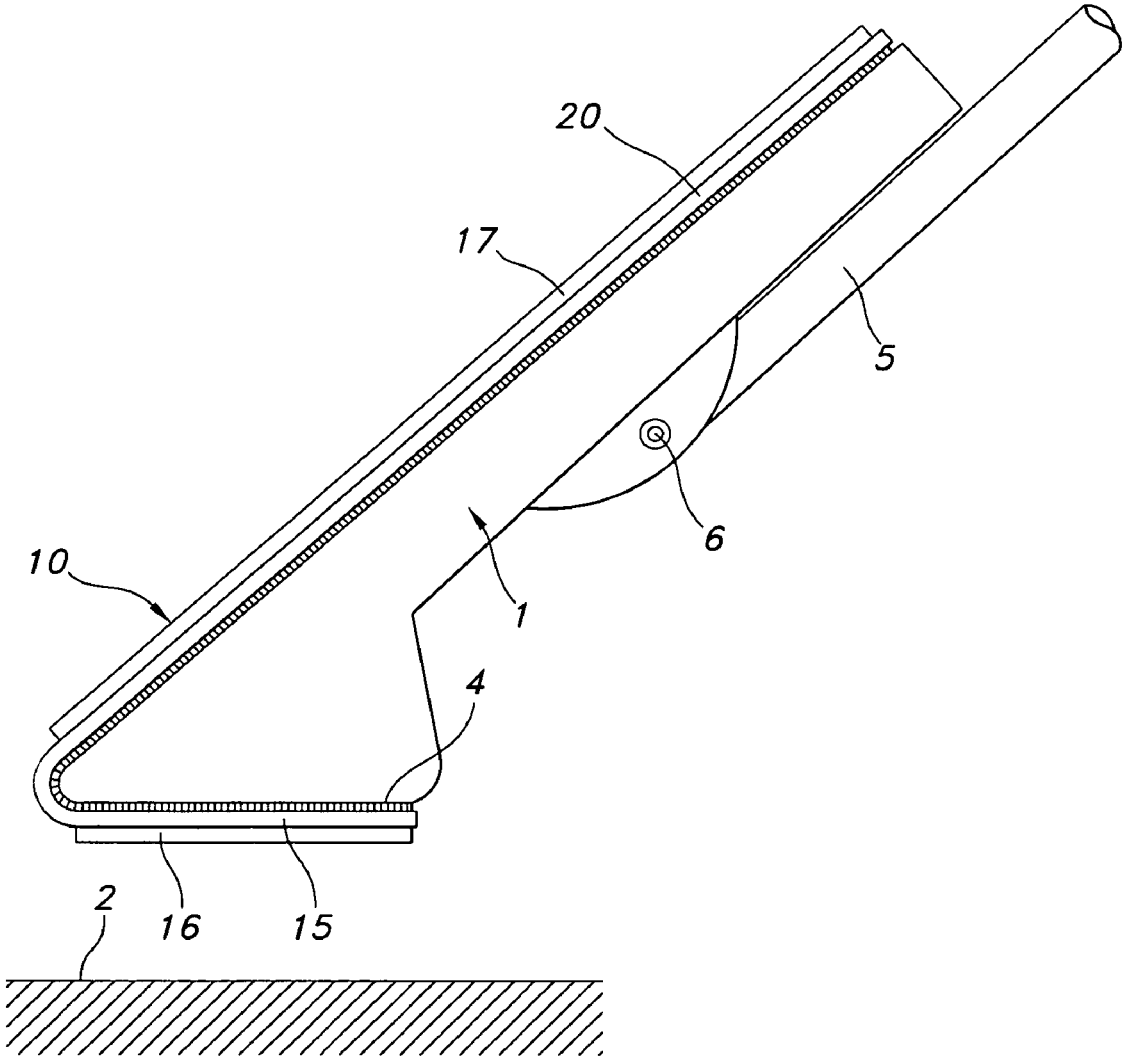
FIG. 1B is another end view of the cleaning implement shown in FIG. 1A, shown schematically, wherein the cleaning implement is illustrated in a collection configuration.

Referring to the overall structure of one exemplary embodiment, FIGS. 1A and 1B illustrate a cleaning implement comprising a head portion or mop head 1, a handle 5 pivotably connected to the head portion 1 about a pivot axis 6, and a disposable absorbent cleaning pad 10 releasably coupled to the head portion 1. Generally, the absorbent cleaning pad 10 includes a pad body 12 having a cleansing surface 8 configured for cleansing contact with a surface to be cleaned, and an attachment surface 9 configured to be positioned facing the head portion 1. In use, the cleaning pad 10 is configured to clean, scrub, remove and/or entrap dirt particles on a soiled surface 2. The soiled surface 2 may be a soiled ceramic, linoleum or wood floor, for example, or any other surface.

The head portion 1 of the cleaning implement includes a primary attachment surface 3 and a secondary attachment surface 4. The primary and secondary attachment surfaces are non co-planar. The secondary attachment surface 4 may be separated from the primary attachment surface 3 by an angle "A." The angle "A" may be any angle from about 0 degrees to about 180 degrees, for example. The primary surface and the secondary surface of the mop head are preferably separated by an angle "A" in a range of about 20 to 160 degrees. In commercially available mop heads, for example, the angle "A" is about 45 degrees. The secondary attachment surface 4 may optionally extend along either the length (as shown) or the width of the head portion 1, or portions thereof.

The cleaning pad 10 is releasably coupled to both attachment surfaces 3 and 4 of the head portion 1, as shown. More specifically, a primary portion 20 of the cleaning pad is releasably coupled to the primary attachment surface 3 of the head portion 1, and the secondary portion 15 of the cleaning pad 10 is coupled to the secondary attachment surface 4 of the head portion 1. It follows that the length of the cleaning pad 10 is greater than the length of the primary attachment surface 3 of the head portion 1 so that the pad 10 may be coupled to the secondary attachment surface 4 of the head portion 1. As described with reference to FIG. 2B, an attachment member 18 is provided for releasably mounting the cleaning pad 10 to the primary and secondary attachment surfaces 3 and 4 of the head portion 1.

In a sweeping configuration of the cleaning implement, as shown in FIG. 1A, the primary portion 20 of the cleaning pad 10 is positioned to face the soiled surface 2. In functional terms, the primary portion 20 of the cleaning pad 10 absorbs and retains fluids and/or other matter residing on the soiled surface and collects small dirt particles on the soiled surface.

In a collection configuration of the cleaning implement, as shown in FIG. 1B, the head portion 1 is manually pivoted about its pivot axis 6, relative to the mop handle 5, such that the secondary portion 15 of the cleaning pad 10 is positioned to face the soiled surface 2. An adhesive component 16 mounted to the secondary portion 15 of the cleaning pad 10 is configured to collect pebbles, dust bunnies, or other large dirt particles not removed by the primary portion 20 of the cleaning pad 10. Large dirt particles on the soiled surface adhere to the tacky surface of the adhesive component.

In a common household environment, in the absence of an adhesive component (such as adhesive component 16), large dirt particles are either manually picked up by hand or manually swept into a dust pan. The cleaning implement 10 limits or eliminates the need for the user to either bend down to collect a large dirt particle, or fetch a dust pan and sweep the dirt particle into the dust pan. It can be appreciated that the adhesive component 16 of the cleaning pad 10 confers a benefit in terms of convenience to the user.

Figure 2A:
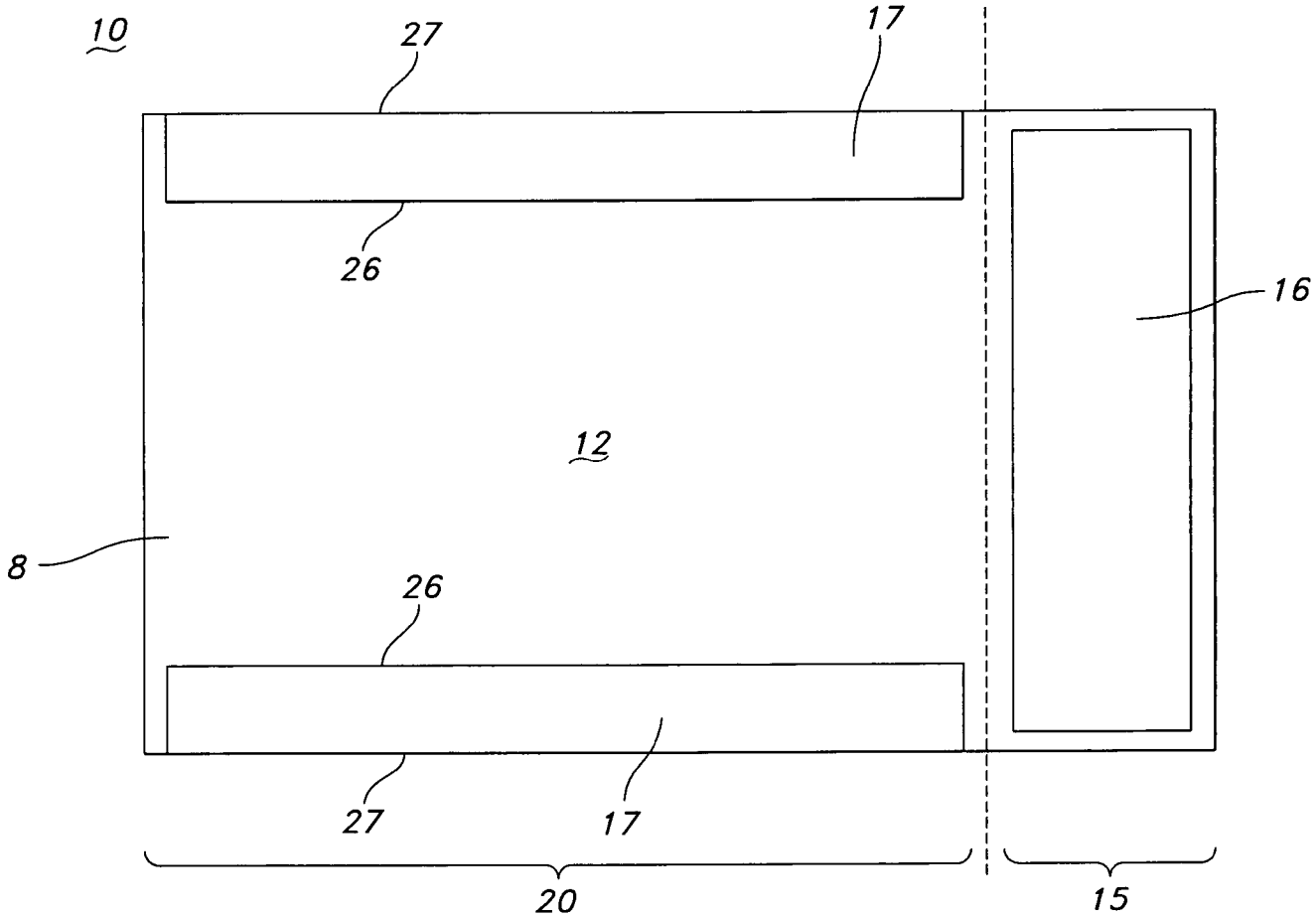
FIG. 2A is a schematic view of a cleaning side of the absorbent cleaning pad shown in FIG. 1A.
Figure 2B:
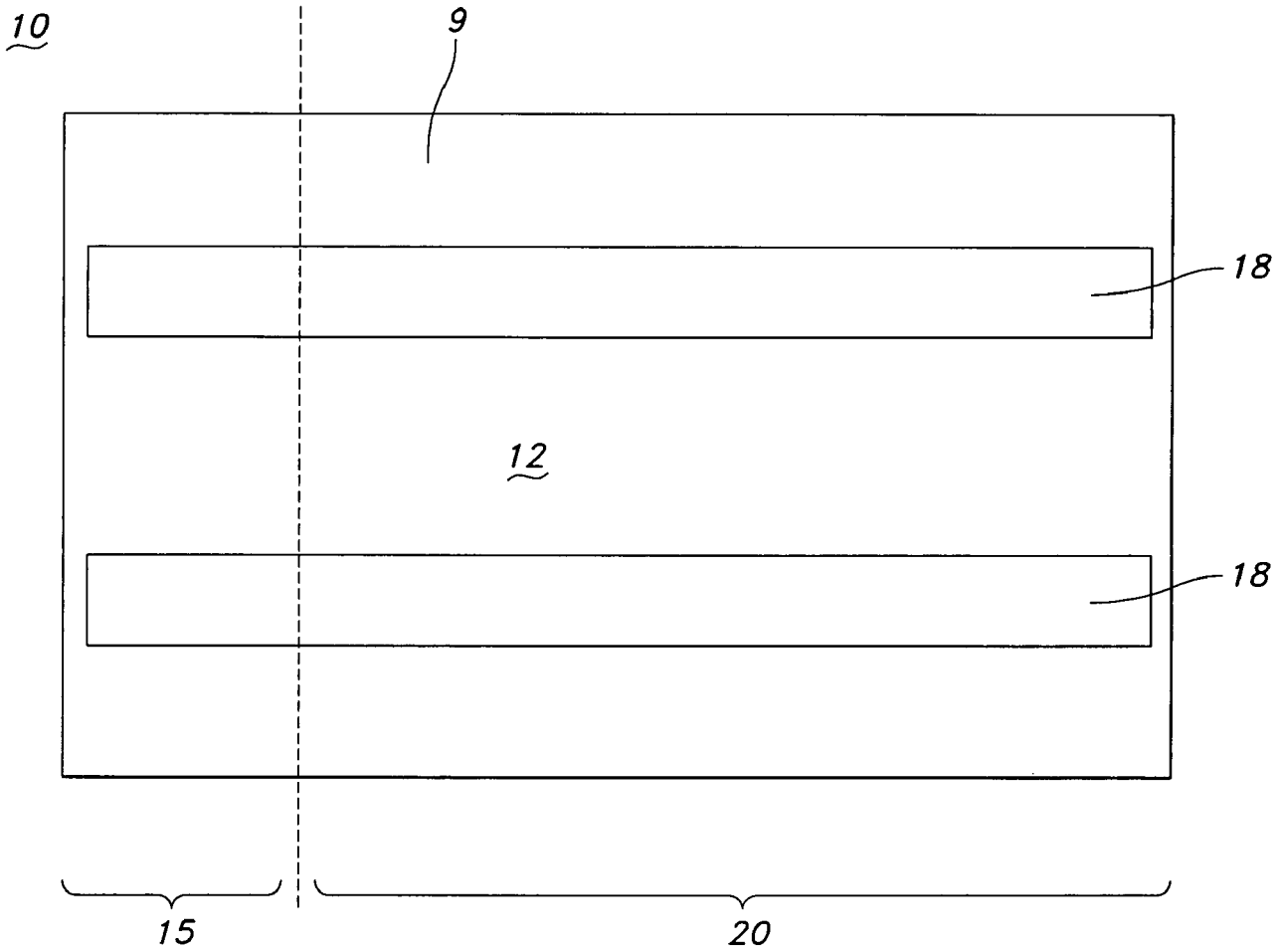
FIG. 2B is a schematic view of an attachment side of the absorbent cleaning pad shown in FIG. 2A.

Referring now to FIGS. 2A and 2B, the cleaning pad 10 of the cleaning implement is illustrated. The cleaning surface 8 and the attachment surface 9 of the cleaning pad 10 are shown in FIGS. 2A and 2B, respectively. The cleaning pad is illustrated schematically in those figures.

As shown in FIG. 2A, the cleaning pad 10 includes a primary portion 20 and a secondary portion 15. The surface area of the primary portion 20 for cleaning the soiled surface, i.e., the cleaning surface area, is optionally greater than the cleaning surface area of the secondary portion 15, the significance of which will be explained with reference to FIG. 4.

The primary portion 20 of the cleaning surface 8 of the cleaning pad 10 optionally includes a pair of dirt entrapment members 17 mounted to each length-wise end of the pad body 12. The length-wise edge 27 of each dirt entrapment member 17 is adhered along the length wise edge of the pad body 12. The shorter width-wise ends of each dirt entrapment member 17 are also adhered to the pad body 12. However, the opposing length wise edge 26 of each dirt entrapment member 17 is not affixed to the pad body 12. Thus, by constraining only three edges of the dirt entrapment member 17, an open pocket is formed between the dirt entrapment member 17 and the pad body 12. In use, dirt particles enter the pocket through the space between the edge 26 of the dirt entrapment member 17 and the pad body 12. The dirt particles are stored in the open pocket. The dirt entrapment members 17 are configured to withstand the pressure and stress associated with typical mopping and scrubbing motions against a surface being cleaned.

The secondary portion 15 of the cleaning surface 8 of the cleaning pad 10 includes an adhesive component 16 mounted thereon. The surface area of the adhesive component 16 may be substantially equal to the surface area of the secondary portion 15 of the cleaning pad 10. Generally, the greater the surface area of the adhesive component 16, the greater the volume of dirt particles that may be collected and retained by the adhesive component 16. However, as not to compromise the sweeping function of the pad 10 or damage the adhesive component 16, the adhesive component 16 is not positioned on the primary portion 20. Although not shown, a release layer may be applied over the tacky surface of the adhesive component 16, for removal prior to use. Also, as described with reference to FIG. 4, the adhesive component may be entirely omitted from the cleaning pad.

As shown in FIG. 2B, two attachment members 18 are mounted to the attachment surface 9 of the pad body 12. The attachment members 18 provide a single attachment mechanism to temporarily couple the cleaning pad 10 to the mop head portion 1. The attachment members 18 extend along the secondary portion 15 and the primary portion 20 of the cleaning pad. The length-wise segment of each attachment member 18 disposed on the primary portion 20 is releasably coupled to the primary attachment surface 3 of the head portion 1, and the length-wise segment of each attachment member 18 disposed on the secondary portion 15 of the cleaning pad 10 is releasably coupled to the secondary attachment surface 4 of the head portion 1. The functional side of the attachment members face away from the pad body 12.

The attachment members 18 are configured to withstand the pressure and stress associated with typical mopping and scrubbing motions against a surface being cleaned. The attachment members 18 also substantially limit the absorbent cleaning pad 10 from shifting, bunching, or otherwise becoming unattached, either partially or in whole, from the mop head. Moreover, the bond between the attachment members 18 and the head portion 1 is preferably greater than the adhesive strength of the adhesive component 16, so that the pad 10 does not become detached from the head portion 1 upon removal of the tacky surface of the adhesive component 16 from a soiled surface.

Although two attachment members 18 are shown, the cleaning pad 10 may include any number of attachment members of any size or shape, as long as an attachment member is located on both the secondary and primary portions of the cleaning pad.

Although not shown, a fluid impervious barrier layer may be adhered to the attachment surface 9 of the primary portion 20 of the pad body 12 to limit or restrict fluid from traveling to the attachment members or the mop head. The barrier layer substantially limits or prevents fluid from passing from the pad body 12 to the mop head or other structure to which the cleaning pad 10 may be attached.

Referring now to the material composition of the exemplary embodiment, the pad body 12 may be a unitized airlaid composite composed of wood pulp, super absorbent polymer (SAP) particles, and binder fibers. The binder fibers form the overall structure of the airlaid composite, and the SAP particles and the wood fibers provide absorbency. The edges of the pad body 12 are sealed to limit 'shake-out' of the SAP particles. The term "unitized" refers to the airlaid as being composed of one material composite. An airlaid composite is commonly fabricated using an airlaying process, as disclosed in U.S. Pat. No. 6,172,276, which is herein incorporated by reference in its entirety. According to U.S. Pat. No. 6,172,276, airlaying is a process by which a fibrous non-woven layer is formed. In the airlaying process, bundles of small fibers, i.e. binder fibers according to the exemplary embodiment, are separated and entrained in an air supply and then deposited by a forming head onto a forming screen in multiple stages, usually with the assistance of a vacuum supply. The randomly deposited fibers then are bonded to one another using, for example, hot air or a spray adhesive. The pad body 12 may be composed of multiple material layers adhered to one another. Other absorbent pad body materials, structures and/or processes are contemplated as well. For example, an absorbent core made of long polymeric filaments prepared by expanding a polymer tow, disclosed in International Publication No. WO 2004/017883, is also contemplated for use as an absorbent pad. The disclosure of International Publication No. WO 2004/017883 is incorporated herein by reference in its entirety.

The adhesive component 16 may be a pressure sensitive adhesive, cohesive, double sided adhesive tape, or any other adhesive. The adhesive strength of the adhesive component 16 is preferably adequate to pick up large dirt particles. However, the adhesive strength of the surface of the adhesive component 16 facing the pad body 12 is preferably greater than the adhesive strength of the surface of the adhesive component 16 facing the surface to be cleaned, such that the adhesive component 16 does not become partially or entirely detached from the cleaning pad 10 in use. Also, the adhesive strength of the surface of the adhesive component 16 facing the pad body 12 is preferably less than the strength of the releasable attachment mechanism by which the pad is coupled to the mop head such that the pad does not become partially or entirely detached from the mop head in use by action of the adhesive component 16 and its adhesion to a surface being cleaned.

The dirt entrapment member 17 material has a relatively large and open pore structure to trap particles and is configured to be flexible, sustain multiple uses and resist tearing or deformation. The dirt entrapment member 17 may optionally be composed of apertured polyethylene or polypropylene films, foams, airlaids, wetlaids, or laminations and combinations thereof. The dirt entrapment member 17 component may be either hydrophilic or hydrophobic.

The attachment members 18 are composed of hook or loop material such as VELCRO loop material available from Velcro USA Inc. of Manchester, N.H. The functional side of the VELCRO loop material faces away from the pad body 12. The attachment member 18 may be composed of any structure or material providing an attachment mechanism to a cleaning implement such as a commercial mop head. Some examples include hook and loop fasteners, adhesives, cohesives, pressure sensitive adhesive, snap-in structures, magnetic elements or any other attachment mechanism commonly known in the art. However, the structure or material of the attachment member 18 is limited to the structure or material of the mating attachment members positioned on the primary and secondary attachment surfaces 3 and 4 of the head portion 1. In other words, if the attachment members positioned on the head portion 1 are loop attachment members, for example, the attachment members 18 of the cleaning pad 10 are preferably hook attachment members. Alternatively, if no attachment members are positioned on the head portion 1, the attachment members 18 of the cleaning pad 10 may be a cohesive or pressure sensitive adhesive.

Figure 3:
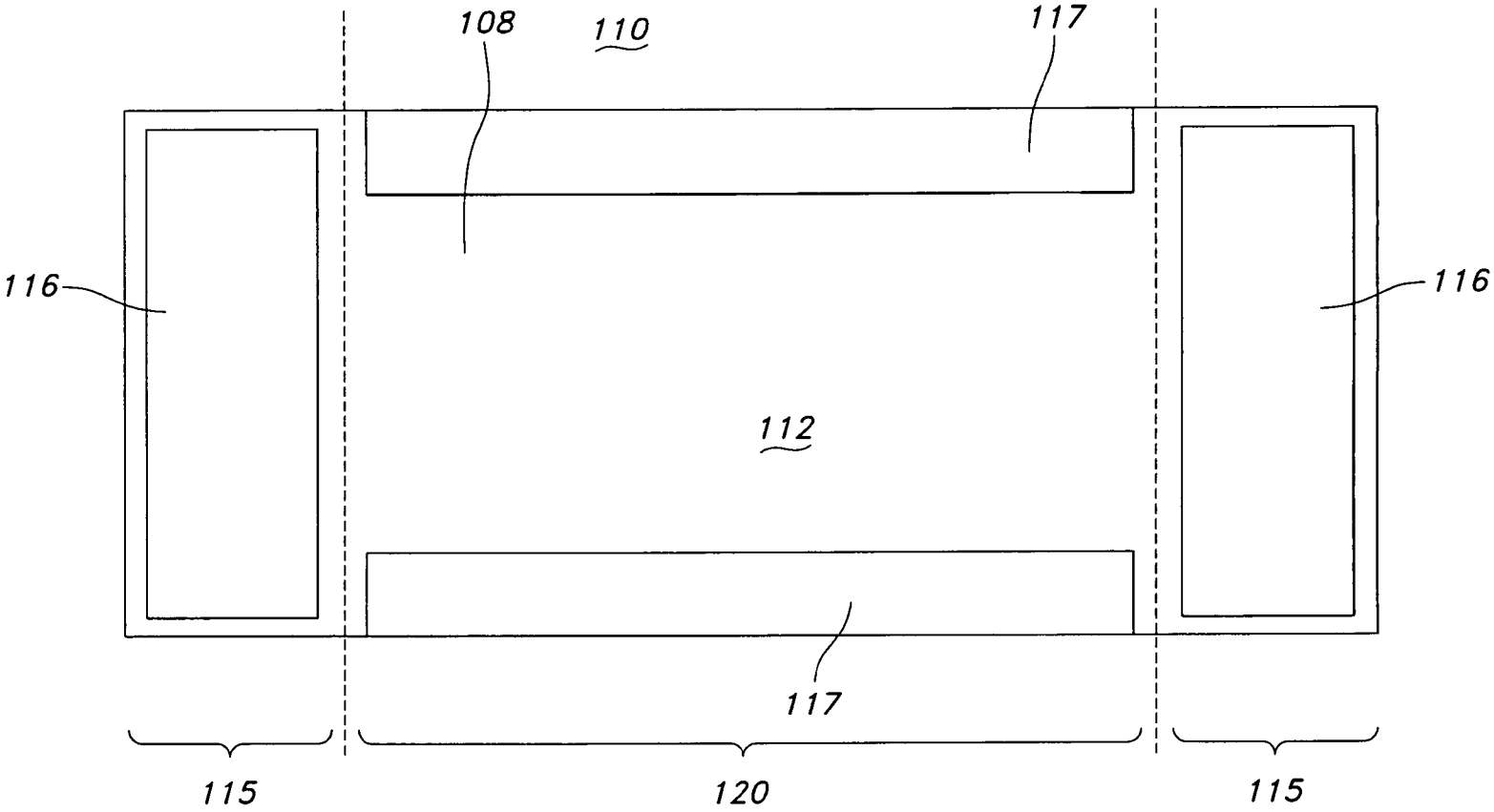
FIG. 3 is a schematic view of the cleaning side of an absorbent cleaning pad in accordance with another exemplary embodiment of the present invention.

Referring now to FIG. 3, another exemplary embodiment of a cleaning pad 110 is shown. The cleaning surface 108 of the cleaning pad 110 is illustrated in FIG. 3. In this exemplary embodiment, the pad 110 includes two secondary portions 115 and a single primary portion 120. The cleaning pad 110 is intended to be applied to a head portion (not shown) having two secondary surfaces on opposite ends of the head portion. Nevertheless, such a head portion could correspond to the head portion shown in FIG. 1A, for example, but with a surface 4 provided on the opposite side of surface 3.

An adhesive component 116 is provided on both secondary portions 115 of the pad 110. In this fashion, the surface area of the adhesive components 116 is greater than the surface area of the adhesive component 16 shown in FIG. 2A. It follows that two adhesive components 116 can retain more dirt particles than a single adhesive component, assuming that the adhesive components are similarly sized.

Figure 4:
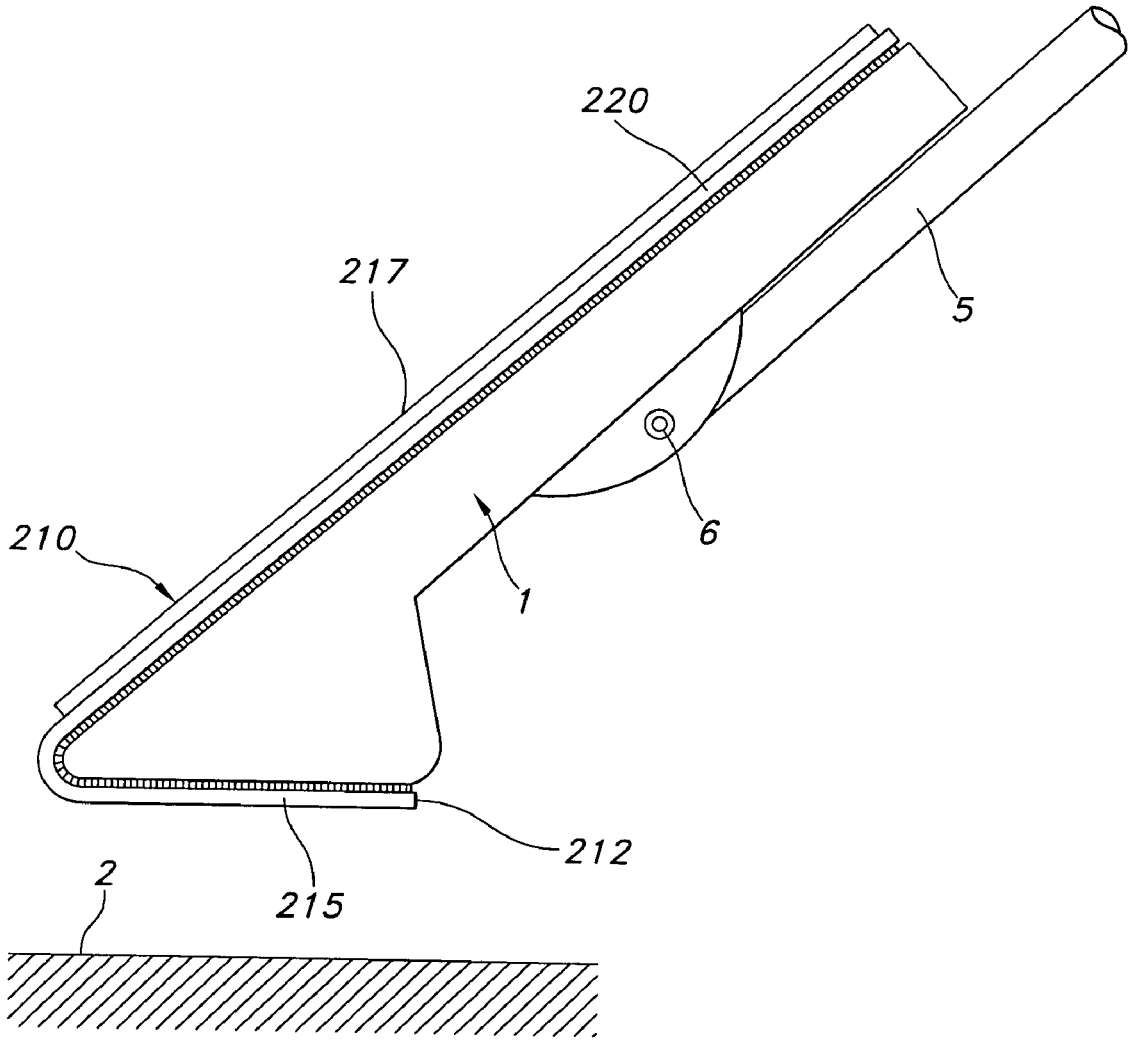
FIG. 4 is an end view of a cleaning implement comprising a head portion and an absorbent cleaning pad, shown schematically, in accordance with another exemplary embodiment of the present invention, wherein the cleaning implement is illustrated in a scrubbing configuration.

Referring now to FIG. 4, another exemplary embodiment of a cleaning pad 210 is illustrated. This exemplary embodiment is similar to the exemplary embodiment illustrated in FIGS. 2A and 2B; however, in this exemplary embodiment, the adhesive component is omitted from the cleaning pad.

The exemplary cleaning implement (including pad 210) is capable of both sweeping and scrubbing a soiled surface. The cleaning implement is configured to sweep the soiled surface when the primary portion 220 of the cleaning pad is applied to the soiled surface, and the cleaning implement is configured to scrub, or deep clean, the soiled surface when the secondary portion 215 of the cleaning pad is applied to the soiled surface 2, as shown.

The cleaning implement is shown in a scrubbing configuration in FIG. 4, whereby the secondary portion 215 of the cleaning pad 210 is positioned adjacent the soiled surface 2. In the scrubbing configuration, the head portion 1 is manually pivoted about its pivot axis 6, relative to the mop handle 5, such that the secondary portion 215 of the cleaning pad 210 is positioned to face the soiled surface 2. The secondary portion 215 of the pad 210 is employed to dislodge stubborn dirt particles from the soiled surface, which the sweeping action of the primary portion 220 can not accomplish alone.

The secondary portion 215 is capable of dislodging stubborn dirt particles, because a user may apply a greater amount of pressure to the soiled surface via the secondary portion 215 of the cleaning pad 210, as compared with sweeping the soiled surface with the primary portion 220 of the cleaning pad, even assuming the user applies the same force to the head portion 1 in both instances. A greater amount of pressure is applied to the soiled surface because the cleaning surface area of the secondary portion 215 is less than the cleaning surface area of primary portion 220. In general, the smaller the surface area of the secondary portion 215 of the pad 210, the greater the amount of pressure that may be applied to the cleaning surface. Mathematically, the pressure applied to the soiled surface by the secondary portion 215 of the cleaning pad is equal to the force applied to the soiled surface by the secondary portion 215 divided by the surface area of the secondary portion 215 of the cleaning pad.

Although not shown, the cleaning surface of the secondary portion 215 of the cleaning pad 10 may incorporate granular particles, surface features, or other such features to increase the friction between the secondary portion 215 and the soiled surface, for dislodging stubborn dirt particles.

Although the invention is illustrated and described herein with reference to specific embodiments, the invention is not intended to be limited to the details shown. Rather, various modifications may be made in the details within the scope and range of equivalents of the claims and without departing from the invention. Also, the embodiments selected for illustration in the figures are not shown to scale and are not limited to the proportions shown. Accordingly, it is intended that the appended claims cover all such variations as fall within the spirit and scope of the invention.

What is claimed:

1. A surface cleaning pad comprising:

a pad body including a primary portion and a secondary portion contiguous with said primary portion;

a primary attachment member coupled to said primary portion of said pad body, said primary attachment member being configured for releasable attachment to a primary surface of a cleaning implement;

a secondary attachment member coupled to said secondary portion of said pad body, said secondary attachment member being configured for releasable attachment to a secondary surface of the cleaning implement, said primary surface and said secondary surface of said cleaning implement being separated by an angle that is less than 90 degrees; and a pair of dirt entrapment members disposed on the primary portion of the pad body, each of the dirt entrapment members forming an open pocket for entrapment of dirt particles, wherein said primary portion and said secondary portion of the pad body are each configured to be independently positioned against a soiled surface.

2. The surface cleaning pad of claim 1, said secondary portion of said pad body having a cleaning surface area less than a cleaning surface area of said primary portion of said pad body.

3. The surface cleaning pad of claim 1, said secondary portion including an adhesive component for collecting dirt particles from the soiled surface.

4. The surface cleaning pad of claim 3, wherein said adhesive component is selected from the group consisting of an adhesive, a pressure sensitive adhesive, a cohesive, and a double-sided adhesive tape.

5. The surface cleaning pad of claim 1, said secondary portion including an abrasive surface adapted for scrubbing the soiled surface.

6. The surface cleaning pad of claim 1 wherein said primary or secondary attachment member is selected from the group consisting of a hook fastener, a loop fastener, a cohesive, and a pressure sensitive adhesive.

7. The surface cleaning pad of claim 1 wherein the cleaning implement comprises a mop head.

8. The surface cleaning pad of claim 1, said pad body comprising a primary portion and two secondary portions contiguous with said primary portion, each of said primary portion and said secondary portions of the pad body being configured to be independently positioned against a soiled surface.

9. The surface cleaning pad of claim 8 wherein said secondary portions are positioned on opposite sides of said primary portion.

10. A surface cleaning pad comprising:

a pad body including a primary portion and a secondary portion contiguous with said primary portion;

an attachment member coupled to said pad body and configured for releasable attachment to a cleaning implement, a primary surface and a secondary surface of said cleaning implement being separated by an angle that is less than 90 degrees;

an adhesive component positioned on said secondary portion configured for removing dirt from a soiled surface, wherein said primary portion and said secondary portion of the pad body are each configured to be independently positioned against the soiled surface; and a pair of dirt entrapment members disposed on the primary portion of the pad body, each of the dirt entrapment members forming an open pocket for entrapment of dirt particles.

11. The surface cleaning pad of claim 10 wherein said adhesive component is selected from the group consisting of an adhesive, a pressure sensitive adhesive, a cohesive, and a double-sided adhesive tape.

12. The surface cleaning pad of claim 10 wherein said attachment member is selected from the group consisting of a hook fastener, a loop fastener, a cohesive, and a pressure sensitive adhesive.

13. The surface cleaning pad of claim 10 wherein the cleaning implement comprises a mop head.

14. A surface cleaning implement comprising:

a head portion defining a primary surface and a secondary surface, wherein said primary surface and said secondary surface are separated by an angle that is less than 90 degrees;

a pad body including a primary portion and a secondary portion contiguous with said primary portion;

at least one attachment member coupled to said pad body; and a pair of dirt entrapment members disposed on the primary portion of the pad body, each of the dirt entrapment members forming an open pocket for entrapment of dirt particles, wherein said primary portion of said pad body is releasably coupled to the primary surface of the head portion by the at least one attachment member, and said secondary portion of said pad body is releasably coupled to the secondary surface of the head portion by said at least one attachment member;

wherein the primary and secondary portions of said pad body are each configured to be independently positioned against a soiled surface.

15. The surface cleaning implement of claim 14, said secondary portion of said pad body having a cleaning surface area less than a cleaning surface area of said primary portion of said pad body.

16. The surface cleaning implement of claim 14, said secondary portion of said pad body including an abrasive surface adapted for scrubbing the soiled surface.

17. The surface cleaning implement of claim 14, said secondary portion of said pad body including an adhesive component for collecting dirt particles from the soiled surface.

18. The surface cleaning implement of claim 17, wherein said adhesive component is selected from the group consisting of an adhesive, a pressure sensitive adhesive, a cohesive, and a double-sided adhesive tape.

19. The surface cleaning implement of claim 14 wherein said head portion comprises a mop head.

20. The surface cleaning implement of claim 19 further comprising a handle coupled to said mop head.

21. The surface cleaning implement of claim 20 wherein said handle and said mop head are configured to be pivoted with respect to each other for positioning said secondary portion of said pad body adjacent the soiled surface in one configuration of said cleaning implement, and for positioning said primary portion of said pad body adjacent the soiled surface in another configuration of said cleaning implement.

22. The surface cleaning implement of claim 14 wherein said primary surface and said secondary surface of said head portion are separated by an angle in a range of about 20 to 90 degrees.

23. The surface cleaning implement of claim 22 wherein said primary surface and said secondary surface of said head portion are separated by an angle of about 45 degrees.

* * * * *